US007088037B2

(12) United States Patent
Raina

(10) Patent No.: US 7,088,037 B2
(45) Date of Patent: Aug. 8, 2006

(54) FIELD EMISSION DISPLAY DEVICE

(75) Inventor: Kanwal K. Raina, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 10/086,555

(22) Filed: Mar. 4, 2002

(65) Prior Publication Data

US 2002/0119328 A1 Aug. 29, 2002

Related U.S. Application Data

(62) Division of application No. 09/387,776, filed on Sep. 1, 1999, now abandoned.

(51) Int. Cl.
*H01J 1/304* (2006.01)
*H01J 1/62* (2006.01)

(52) U.S. Cl. ..... 313/496; 313/495; 313/310

(58) Field of Classification Search ..... 313/495, 313/496, 497, 336, 309, 310, 351; 445/24
See application file for complete search history.

(56) References Cited

U.S. PATENT DOCUMENTS 5,210,472 A 5/1993 Casper et al.
5,319,279 A * 6/1994 Watanabe et al. ..... 313/309
5,371,431 A * 12/1994 Jones et al. ..... 313/309
5,747,384 A * 5/1998 Miyamoto ..... 438/685
5,808,400 A 9/1998 Liu
5,825,126 A 10/1998 Kim
5,840,118 A * 11/1998 Yamazaki ..... 117/103
5,853,492 A * 12/1998 Cathey et al. ..... 134/3
5,869,169 A 2/1999 Jones
6,086,442 A * 7/2000 Sandhu et al. ..... 445/24

OTHER PUBLICATIONS

J. Kanicki editor, Amorphous and Microcrystalline Semiconductor Devices: Optoelectronic Devices, 1991 (no month), pp. 119-123.*
John H. Das et al., "Low Work Function Addressable Silicon Field Emission Single Cathode with Integrated Lateral Feedback Resistor and Suspended Heater", School of Electrical Engineering, pp. 47-51, Jul./Aug. 1995.
W.A. Mackie, "Work Function Measurements of Diamond Film Surfaces", Linfield Research Institute, pp. 2041-2045, May/Jun. 1995.

(Continued)

*Primary Examiner*—Karabi Guharay
(74) *Attorney, Agent, or Firm*—Dickstein, Shapiro, Morin & O'Shinsky

(57) ABSTRACT

A system and method for fabricating a FED device is disclosed. The system and method provide for use of PECVD hydrogenation followed by nitrogen plasma treatment of the tip of the current emitter of the FED device. The use of this process greatly reduces the native oxides in the tip of the current emitter. Such native oxides function as undesirable insulators degrading current emission. By reducing the amount of oxides in the tip, this invention provides for an increase in the current emission of the FED device.

18 Claims, 6 Drawing Sheets

OTHER PUBLICATIONS

Qing-An Huang et al., "The Advantages of N-Type Heavily-Doped Silicon as an Emitter for Vacuum Microelectronics", 9th International Vacuum Microelectronics Conference, 1996, pp. 155-157, no month.

B.C. Djubua et al., "Emission Properties of Spindt-Type Cold Cathodes with Different Emission Cone Material", IEEE Transactions on Electron Device, vol. 38, No. 10, Oct. 1991, pp. 2314-2316, no month.

Qi-Lue Chen et al., "Investigation of Electron Tunnelling Emitter", Beijing Vacuum Electronics Research Institute, pp. 488-490, Jul./Aug. 1995.

J. Ishikawa et al, "Cone-Shaped Metal Insulator Semiconductor Cathode for Vacuum Microelectronics", Dept. of Electronic Science and Engineering, Japan, pp. 1970-1972, May/Jun. 1996.

* cited by examiner

| SAMPLE | O | N | Si |
|---|---|---|---|
| 1 (WITHOUT SURFACE TREATMENT) | 32.5 | 0.0 | 63.4 |
| 2 (WITH SURFACE TREATMENT) | 20.9 | 33.9 | 34.7 |

FIG. 4

FIELD EMISSION DISPLAY DEVICE

BACKGROUND OF THE INVENTION

This application is a divisional application of U.S. patent application Ser. No. 09/387,776, filed Sep. 1, 1999, now abandoned, the entirety of which is incorporated herein by reference.

I. Field of the Invention

The present invention relates generally to display devices implementing Field Emission Display (FED) technology. More specifically, the invention relates to a method for increasing the emission current of the current emitters of a Field Emission Display (FED).

II. Description of the Related Art

Until recently, the cathode ray tube ("CRT") had been the primary device for displaying information. While having sufficient display characteristics with respect to color, brightness, contrast, and resolution, CRT's are relatively bulky and consume large amounts of power. In view of the advent of portable laptop computers, the demand has intensified for a display technology which is light-weight, compact, and power efficient.

One available technology is flat panel displays, and more particularly, Liquid Crystal Display ("LCD") devices. LCDs are currently used for laptop computers. However, these LCD devices provide poor contrast in comparison to CRT technology. Further, LCDs offer only a limited angular display range. Moreover, color LCD devices consume power at rates incompatible with extended battery operation. Lastly, a color LCD type screen tends to be far more costly than an equivalent CRT.

FED technology has recently come into favor as one technology for developing low power, flat panel displays. This technology uses an array of cold cathode emitters and cathodoluminescent phosphors for conversion of energy from an electron beam into visible light. Part of the desire to use FED technology for flatpanel displays is that such technology is conducive to producing flat screen displays having high performance, low power and light weight.

In FED structures and devices a plurality (array) of microelectronic emission elements are employed to emit a flux of electrons from the surface of the emission element(s). The emitter surface, referred to as a "tip", is specifically shaped to facilitate effective emission of electrons, and may for example be conical, pyramidal, or ridge-shaped in surface profile, or alternatively the tip may comprise a flat emitter surface of low work function material.

In the construction of FED current emitters, various materials are deposited onto a substrate to form the device. Thereafter, a panel containing spaced phosphors is sealed to a panel containing the emitters under conditions where the temperature is approximately 400 degrees Celsius. When the material used to construct the FED current emitter tip, an amorphous silicon doped with boron or phosphorus, is deposited, native oxides form on the tip due to exposure to the atmosphere. This change in the chemical nature of the tip results in an increased work function yielding a decrease in the current emission of the tip nearly ten fold. As a general principal the work function is an instrumental factor in the resulting current emission. The practical effect is the manifestation of a display which is dimmer than that desired or expected, often resulting in an increase in power usage in order to try to achieve a brighter display.

SUMMARY OF THE INVENTION

The present invention relates to a system and method for increasing the emission current of the current emitters of a FED device by removing native oxygen from silicon deposited on the tip of the FED device through PECVD hydrogenation and subsequently incorporating nitrogen onto the surface without exposing the tip to the atmosphere.

In the invention an amorphous silicon tip doped with boron or phosphorus is subjected to PECVD hydrogenation followed by an infusing nitrogen plasma, preferably a $NH_3$ plasma, which deposits onto the tip surface, while the FED structure is still in the PECVD chamber. PECVD hydrogenation removes oxides from the silicon surface by infusing hydrogen. The result is the tip being free of approximately one third of the native oxides, which formed when the tip was exposed to atmospheric conditions and which would have otherwise remained on the tip increasing the work function and yielding a less than desirable emission current. The nitrogen plasma treatment is used to complete the process. After the PECVD and nitrogen plasma treatment, the FED structure is sealed in a vacuum under high temperature.

BRIEF DESCRIPTION OF THE DRAWINGS

The foregoing and other advantages and features of the invention will become more apparent from the detailed description of preferred embodiments of the invention given below with reference to the accompanying drawings in which:

FIG. 4 is a chart comparing the present invention to the prior art in terms of oxygen, nitrogen and silicon present in the FED tip after fabrication;

DETAILED DESCRIPTION OF PREFERRED EMBODIMENTS

Figure 1:
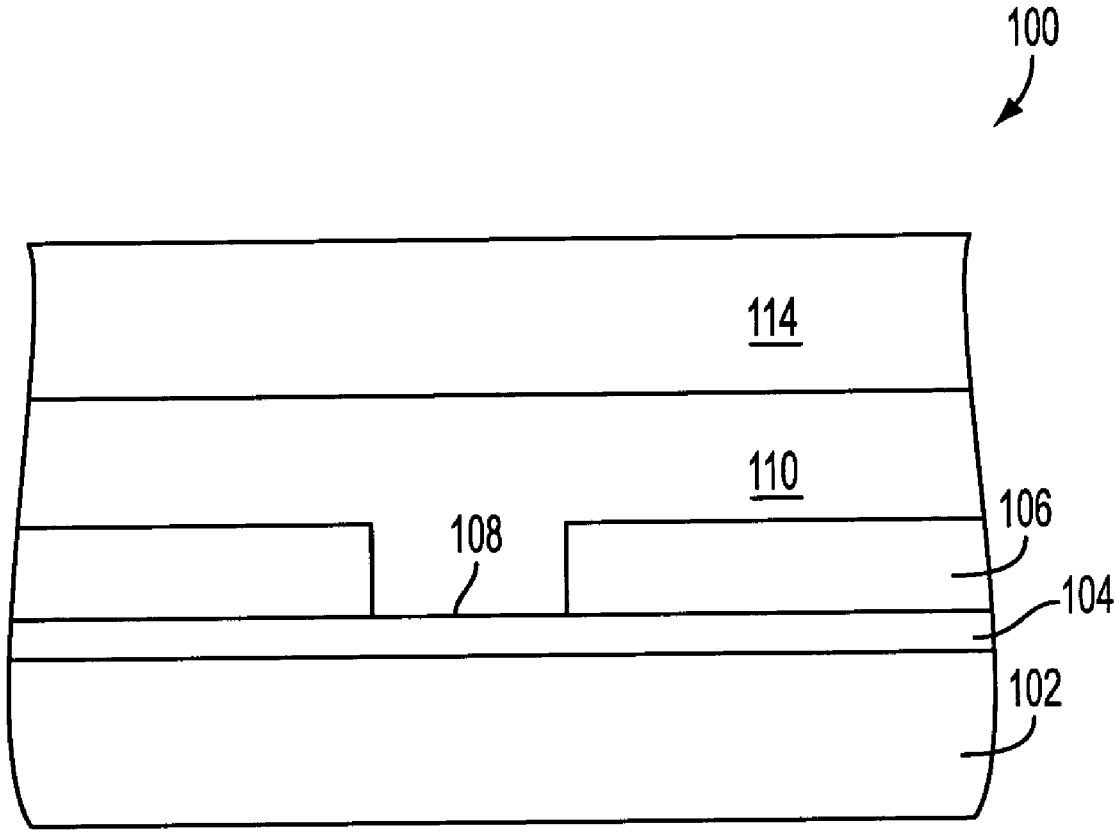
FIG. 1 is a cross sectional view of the material composition of a FED device in accordance with a preferred embodiment of this invention at an early stage of processing.

Referring now to the drawings, where like reference numerals designate like elements. FIG. 1 is a representative cross-section of a FED device 100. FED device 100 contains a substrate 102 made of glass upon which the materials making up the functional part of the FED device are deposited. The glass substrate 102 often contains impurities such as sodium, therefore, a "barrier film" 104, in this instance silicon dioxide ($SiO_2$), is deposited on top of the substrate 102 as an insulator. This barrier film 104 is deposited using PECVD processing. Next, a conductive metal layer 106 is deposited in a desired pattern on top of the barrier film 104. This conductive metal layer 106 is formed preferably of an aluminum alloy which may contain chromium. This conductive metal layer 106 is patterned to form vacant areas 108 where the conductive metal layer 106 does not cover the barrier layer 104. These vacant areas 108 will hold the base of a later formed FED tip. After conductive metal layer 106 is formed, a layer of amorphous silicon doped with boron 110 is deposited followed by the deposition of a layer of amorphous silicon doped with phosphorus 114. Layers 110 and 114 are deposited using PECVD processing.

Figure 2:
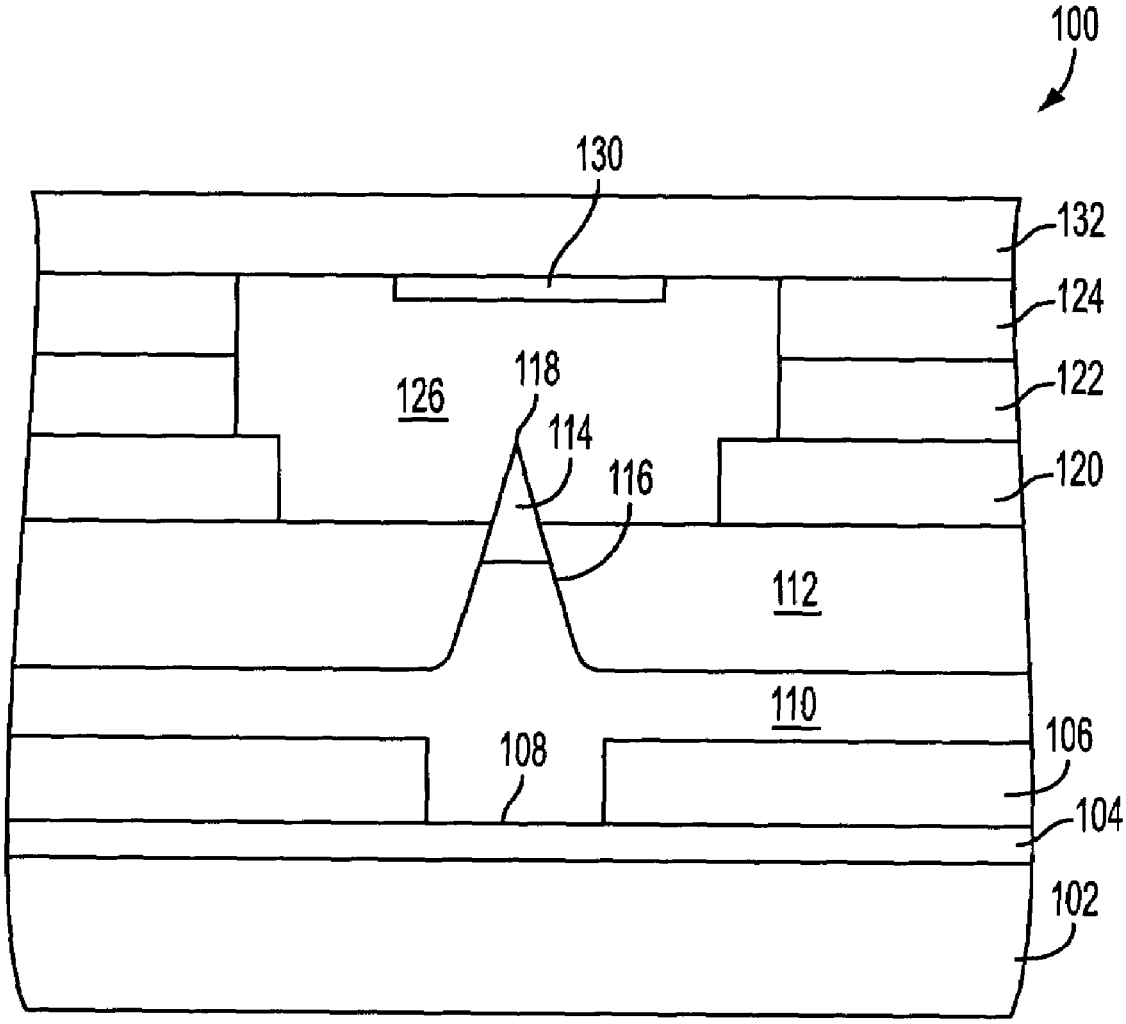
FIG. 2 is a cross sectional view of the device in FIG. 1 at a subsequent stage of processing.

Next, as shown in FIG. 2, layers 110 and 114 are etched to form a current emitter 116 in an extended shape. Preferably emitter 116 is formed in a conical shape, but other shapes can be formed as well.

To finish the construction of the FED device 100, silicon dioxide is deposited using PECVD processing to form a insulating layer 112 around the sides of the current emitter 116. The insulating layer 112 is provided around the sides of the current emitter 116 so that current does not radiate out of the sides of the current emitter 116 and provide cross-talk to nearby current emitters. Furthermore, this insulating layer 112 helps direct the current to the tip 118 of the current emitter 116 which is desired.

A grid layer 120 is then deposited using PECVD. The grid layer 120 is composed of amorphous silicon doped with phosphorus. Another metal layer 122 is deposited using DC magnetron sputtering on top of grid layer 120. Lasdy, a passivation layer 124, containing nitride, is deposited on top of the metal layer 122. To ensure an opening for emission current to pass from the tip 118, an open area 126 is etched from the passivation layer 124 down to the insulating layer 112.

At this point native oxides are present in the tip 118 as a result of the silicon at tip 118 being exposed to the atmosphere. If left untreated, these natural oxides will reduce the emission current at the tip 118 approximately ten fold. To combat this problem, this invention, treats the tip 118 of FIG. 2 with a PECVD hydrogenation process and subsequently with a nitrogen plasma process while the FED device 100 is still in the PECVD chamber. The nitrogen plasma treatment should occur while the FED device 100 is still in the PECVD chamber to reduce the possibility of atmosphere contamination.

This PECVD hydrogenation is performed with about 1000 sccm silane gas flow, with the RF power set between about 200–300 watts, and the PECVD chamber pressure at about 1200 mtorr for a period of about 5 to 10 minutes. The nitrogen plasma treatment is performed with about 500 sccm $NH_3$ (ammonia) gas flow, with the RF power set between about 300–400 watts, and the PECVD chamber pressure at about 1200 mtorr for a period of about 10 to 15 minutes. This treatment changes the chemical nature of the current emitter tip 118.

After the PECVD and nitrogen plasma treatment, a panel containing a plurality of FIG. 2 current emitters is heat sealed to a facing faceplate panel containing phosphors 130 with a top surface substrate 132, which oppose the current emitters 116 using conventional techniques under a temperature as high as 400–420 degrees Celsius. The resulting FED device has a lower work function and increased current emission as a consequence of the PECVD hydrogenation and nitrogen plasma treatment.

FIG. 4 illustrates, in a tabular format, the surface atomic concentrations of an oxygen, nitrogen and silicon for a conventional emitter tip without tip surface treatment in accordance with the invention (1) and with the surface treatment in accordance with the invention (2). It shows that the surface treatment of this invention greatly reduces the atomic concentration of silicon and oxygen on the tip (which can form silicon dioxide in the presence of heat). This data was derived by using x-ray photoelectron spectroscopy.

Figure 5:
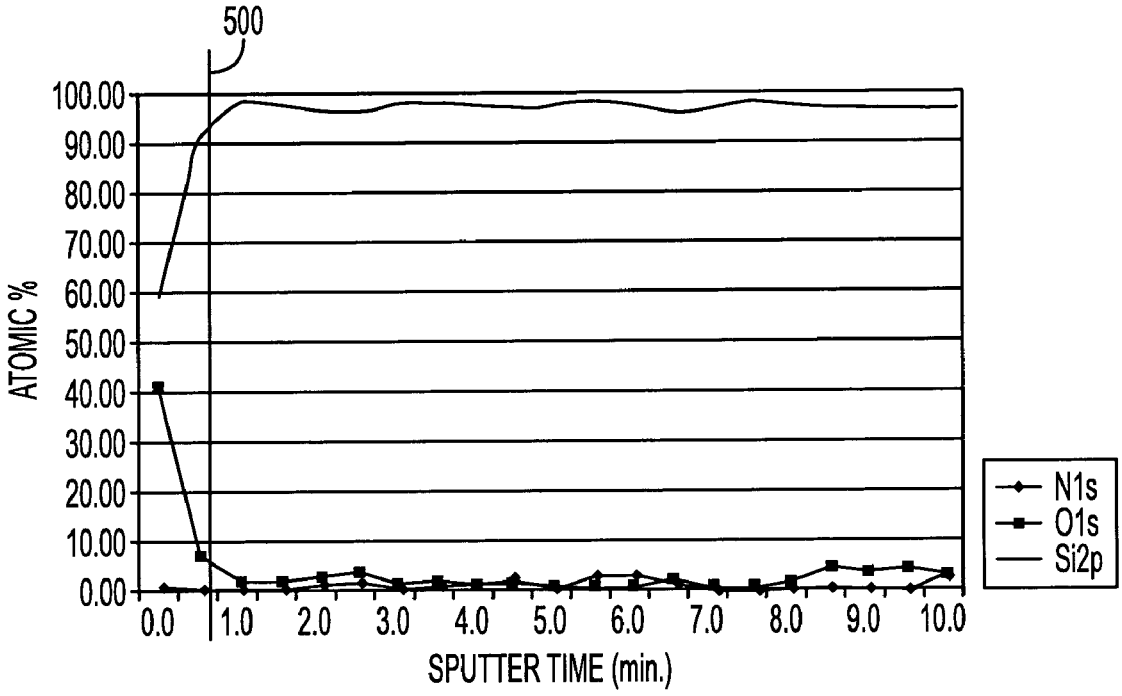
FIG. 5 is a graph plotting the oxygen, nitrogen and silicon concentrations of a FED tip after fabrication according to the prior art.
Figure 6:
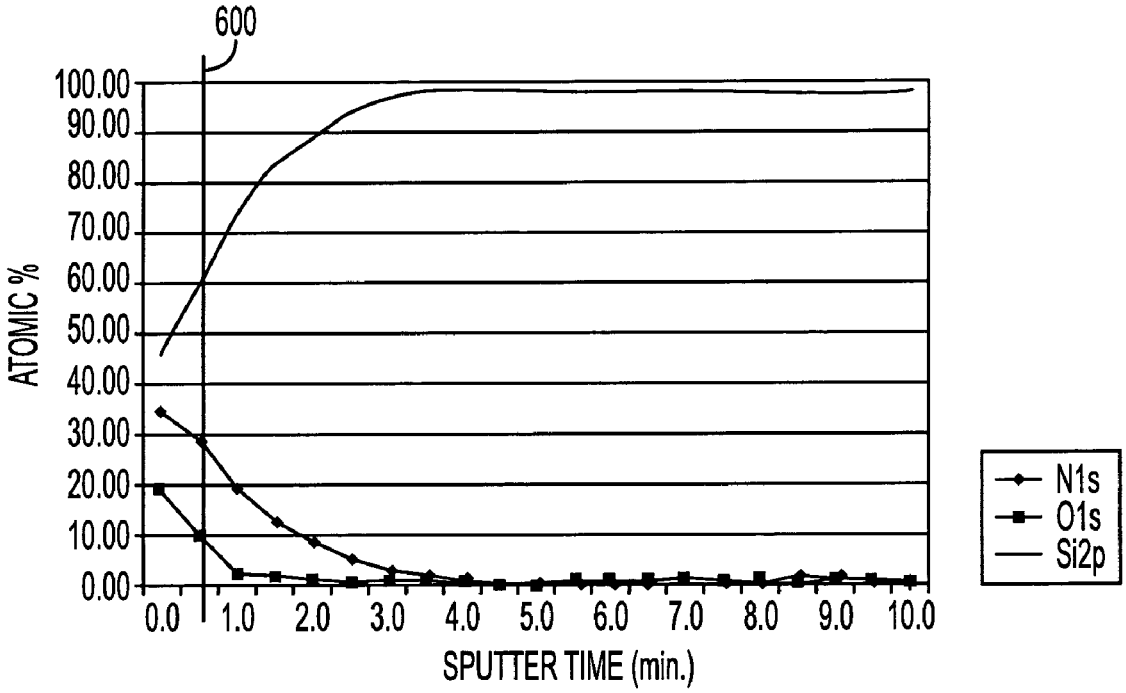
FIG. 6 is a graph plotting the oxygen, nitrogen and silicon concentrations of a FED tip after fabrication according to the present invention.

FIGS. 5 and 6 are graphs of the results of a x-ray photoelectron spectroscopy (XPS) analysis of the emitter tips. These graphs show the atomic percentages of nitrogen, oxygen, and silicon verses sputter time for a conventional emitter tip without surface treatment in accordance with this invention and for an emitter tip with tip surface treatment in accordance with this invention, respectively. These graphs were generated by the XPS inspection apparatus after the FED devices 100 were already fabricated. Thus, "sputter time" as illustrated in FIGS. 5 and 6 pertains solely to the sputter time of the XPS inspection apparatus not to sputter time in relation to the fabrication of the FED device 100.

A comparison of FIGS. 5 and 6, focusing on the data to the left of lines 500 and 600, shows that treatment in accordance with this invention does change the surface chemistry of the current emitter. The most obvious chemical changes being the reduction of oxygen and presence of nitrogen in FIG. 6. This confirms the data illustrated in FIG. 4.

Figure 3:
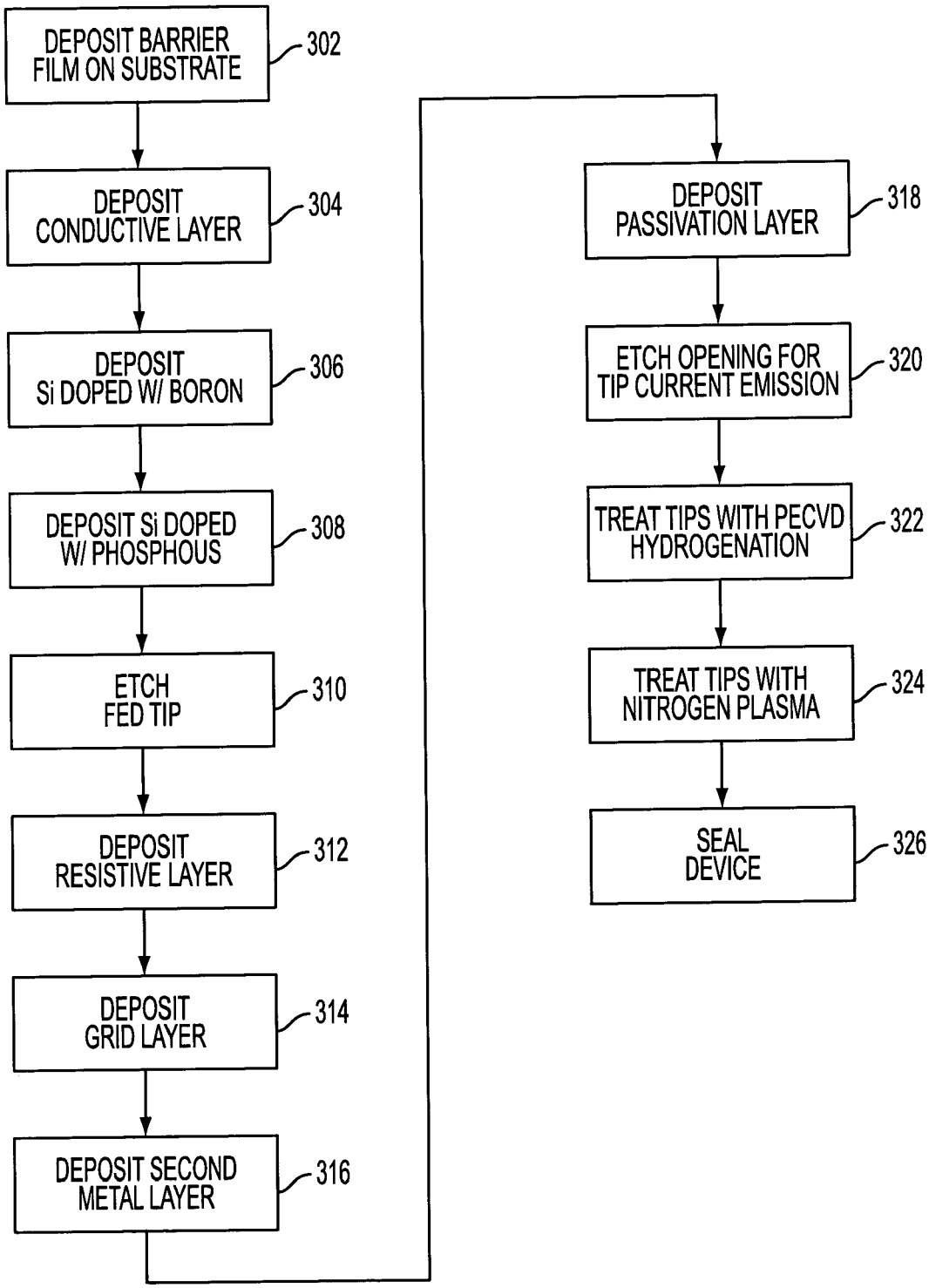
FIG. 3 is a flow chart illustrating the process steps in accordance with a preferred embodiment of this invention.

The overall process of the invention is illustrated in FIG. 3. The barrier film layer 104 is first deposited on the substrate 102 using PECVD processing 302. The conductive layer 106 is then deposited using DC magnetron sputtering, where patterning is included for the base of the current emitter 116 to be formed 304 and for electrode contact with the current emitters 116. The current emitter 116 is constructed by the deposition of silicon doped with boron 110, 306 and silicon doped with phosphorus 114, 308. The current emitter 116 is then etched forming a tip 118 at the top of the structure 310. The insulating layer 112 is then deposited using PECVD processing 312. Next, the grid 120 is deposited also using PECVD 314. A second metal layer 122, 316 and the deposit of a passivation layer 124, 318 complete fabrication of the structure. An area is then etch through the layers formed in steps 314 through 318, so that the current emission from the tip 118 can reach the upper surface of the FED device 100. The tip 118 is then treated with PECVD hydrogenation 322 followed by an infusion of nitrogen on the tip 324 while the tip 118 is still in the PECVD chamber. Lastly, a panel containing the formed FED device 100 is sealed under a high temperature 326 to a faceplate panel area containing phosphors 130, where the areas containing phosphors 130 are positioned to align with a respective current emitter.

It is to be understood that the above description is intended to be illustrative and not restrictive. Many variations to the above-described method and structure will be readily apparent to those having ordinary skill in the art. For example, the micropoint structures may be manufacture with more than one insulating layer.

Accordingly, the present invention is not to be considered as limited by the specifics of the particular structures which have been described and illustrated, but is only limited by the scope of the appended claims.

What is claimed as new and desired to be protected by Letters Patent of the United States is:

1. A field emission display device comprising:

at least one current emitter formed of a doped silicon, said current emitter having a tip from which emission current is emitted, wherein said tip comprises nitrogen; and a substrate having a phosphor coating in at least one region positioned to receive electrons emitted by said current emitter, said current emitter further comprising sides below said tip, wherein at least a portion of said sides are surrounded by an insulating layer to prevent current from radiating out of the sides.

2. The device according to claim 1, wherein said current emitter resides on a base substrate covered by a barrier film.

3. The device according to claim 2, wherein said barrier film comprises silicon dioxide.

4. The device according to claim 2, wherein said current emitter has a base on said barrier layer and a projecting top connected with said base.

5. The device according to claim 2, further comprising a conductive layer deposited over said barrier film.

6. The device according to claim 5, wherein said conductive layer comprises aluminum.

7. The device according to claim 1, wherein said insulating layer comprises silicon dioxide.

8. The device according to claim 1, wherein a silicon grid resides on top of said insulating layer.

9. The device according to claim 8, wherein a metal layer resides on top of said grid.

10. The device according to claim 9, wherein a passivation layer resides on top of said metal layer.

11. The device according to claim 10, wherein said passivation layer comprises nitride.

12. A field emission display device comprising:

at least one current emitter having sides; and a substrate having a phosphor coating on at least a portion of the substrate, said coating positioned to receive electrons emitted by the current emitter, said current emitter comprising a surface-treated focal point formed on said current emitter, wherein said focal point emits current emissions, wherein said focal point comprises nitrogen, and wherein at least a portion of the sides of the at least one current emitter is surrounded by an insulating layer abutting the sides of the at least one current emitter.

13. The device according to claim 12, wherein said surface-treated focal point has atomic concentrations of oxygen and silicon reduced by a plasma enhanced chemical vapor deposition hydrogenation process and a subsequent nitrogen infusion process to values smaller than the atomic concentration of oxygen and silicon of a non-treated focal point subjected to atmospheric conditions.

14. A field emission display device comprising:

an array of current emitters, wherein each current emitter has sides; and a substrate having a phosphor coating in at least one region positioned to receive electrons emitted by said current emitters, said current emitters each comprising an emission focal point for emitting current emissions, wherein said emission focal point comprises comprising doped silicon infused with nitrogen, and wherein at least a portion of the sides of the current emitters are surrounded by an insulating layer abutting the sides of the current emitters.

15. A field emission display device comprising:

at least one current emitter with sides; and a substrate having a phosphor coating in at least one region positioned to receive electrons emitted by said current emitter, said current emitter comprising a top and bottom surface, said top surface comprising nitrogen, and wherein at least a portion of the sides of the at least one current emitter is surrounded an insulating layer abutting the sides of the at least one current emitter.

16. A field emission display device unit comprising:

a current emitter having a top and bottom surface, wherein said top surface is a surface-treated top surface, and wherein said surface-treated top surface comprises nitrogen; and a substrate having a phosphor coating in at least one region positioned to receive electrons emitted by said current emitter, wherein said current emitter further comprises sides below said top surface, wherein at least a portion of said sides are surrounded by an insulating layer abutting said sides.

17. A field emission display device comprising:

a plurality of current emitters each having a top and bottom surface, wherein said each top surface is a surface-treated top surface, and wherein said each surface-treated top surface comprises nitrogen; and a substrate having a phosphor coating in at least one region positioned to receive electrons emitted by said current emitters, wherein each current emitter further comprises sides below said top surface, wherein at least a portion of said sides are surrounded by an insulating layer abutting said sides.

18. A current emitter for use in a field emission display device, said current emitter comprising:

a top and bottom surface, said bottom surface being formed over a semiconductor substrate, and wherein said top surface is a treated top surface comprising nitrogen, wherein said current emitter further comprises sides below said top surface, wherein at least a portion of said sides are surrounded an insulating layer abutting said sides.

* * * * *

UNITED STATES PATENT AND TRADEMARK OFFICE

CERTIFICATE OF CORRECTION

PATENT NO. : 7,088,037 B2
APPLICATION NO. : 10/086555
DATED : August 8, 2006
INVENTOR(S) : Kanwal K. Raina It is certified that error appears in the above-identified patent and that said Letters Patent is hereby corrected as shown below:

Column 3, lines 6-7, “a insulating” should read --an insulating--;

Column 4, line 28, “etch” should read --etched--; and

Column 4, line 44, “manufacture” should read --manufactured--.

In the Claims, the following error is corrected:

Claim 15, column 6, line 8, “surrounded an” should read --surrounded by an--.

Signed and Sealed this

Twelfth Day of December, 2006

JON W. DUDAS
*Director of the United States Patent and Trademark Office*